US008672770B2

(12) United States Patent
Matt

(10) Patent No.: US 8,672,770 B2
(45) Date of Patent: Mar. 18, 2014

(54) STAND UP SWING APPARATUS

(76) Inventor: David J Matt, Long Beach, CA (US)

( * ) Notice: Subject to any disclaimer, the term of this patent is extended or adjusted under 35 U.S.C. 154(b) by 147 days.

(21) Appl. No.: 13/438,539

(22) Filed: Apr. 3, 2012

(65) Prior Publication Data

US 2013/0260905 A1 Oct. 3, 2013

(51) Int. Cl.
*A63G 9/12* (2006.01)

(52) U.S. Cl.
USPC ..... 472/118; 472/135; 482/71

(58) Field of Classification Search
USPC ..... 472/118, 120–125, 135; 482/71, 143
See application file for complete search history.

(56) References Cited

U.S. PATENT DOCUMENTS 4,289,310 A * 9/1981 Weakly ..... 472/118
5,163,828 A * 11/1992 Coddington, Jr. ..... 472/118
5,511,258 A * 4/1996 Barr, Sr. ..... 5/104
5,624,321 A * 4/1997 Snyder ..... 472/118
6,932,710 B1 * 8/2005 Hartin ..... 472/118
7,485,046 B2 * 2/2009 Dekker ..... 472/135
7,892,151 B2 * 2/2011 Colk et al. ..... 482/71
2011/0263344 A1 * 10/2011 Brown et al. ..... 472/118

* cited by examiner

*Primary Examiner* — Kien Nguyen

(57) ABSTRACT

A recreational amusement stand-up swing apparatus consisting of a singular bracing member anchored to a stationary overhead object. A coupling link element, akin to a swivel-eye carbiner, for the bracing member to attach thereto, further providing a member for the apparatus to be convieniently removed from the bracing member by way of a side gate portion, and further providing a member for unrestricted spinning rotation by way of a swivel mechanism. An extension spring providing vertical bouncing member, comprising upper and lower connecting portions attached between the coupling link and a connecting agent centrally located on a line separator element. A line element comprising right and left arm portions equidistantly extending through the line separator and further comprising stopping agents thereon. The right and left arm portions respectively attaching to right and left supporting bands located atop a rigid platform element and further providing space for a user's feet to be insertably placed therebetween. The right and left arm portions furthermore including line tightener elements thereon for the purpose of adjusting the height of the apparatus relative to the ground.

2 Claims, 5 Drawing Sheets

STAND UP SWING APPARATUS

FIELD OF THE INVENTION

The inventions described below relate to the field of recreational amusement swings, and, more particularly, to a swing that is designed for bouncing, swinging, and/or spinning while standing up.

BACKGROUND OF THE INVENTION

Swings are common recreation apparatuses found in parks, playgrounds and households for the benefit of a user's amusement. The most common of swing inventions found in prior art are designed for use in a seated position. It is desirable to have a swing apparatus designed for use in a standing position, while further providing for unrestricted lateral spinning rotation and vertical bounce capacity.

While there are numerous swing assemblies designed for numerous amusement activities, many of the designs found in prior art make no attempt to provide a swing that is intended for use while standing up, is capable of bouncing and spinning, is quickly and easily attached to and detached from an overhead object, expediently adjusts length to accommodate the distance between an overhead object relative to the ground below, accommodates a wide range of heights of users, provides foot placement bracing means, provides a hollow line separator element through which a line feeds, is not bulky when being stored, is lightweight and simple to manufacture, and can be manufactured from a variety of materials.

Various swings contain a singular bracing means that enable unrestricted lateral rotation by the user. Bishop, et al., Play Swing Apparatus, U.S. Pat. No. 3,918,709 (Nov. 11, 1975) describes a swing device comprising a swivel mechanism and means for attachment to an overhead tree limb or rail by way of a singular chain element. This invention succeeds in providing a laterally rotatable swing, but requires a restrictively rigid, rectangular-shaped metal frame structure as one of its primary components being claimed; is sized such that the rectangular-shaped metal frame structure is designed to fit a child, thereby accommodating a narrow scope of user heights, and furthermore failing to accommodate adult-sized users; fails to provide means for bouncing along a vertical plane; fails to provide bracing means for a user to place their feet atop a platform; limits the length of the platform element to the distance between the opposing sides of the rectangular-shaped metal frame structure; fails to quickly and easily attached to and detached from an overhead object. And finally, the embodiment described in this invention provides two limited means for adjusting height: by way of raising or lowering telescoping side portions of said rectangular-shaped metal frame structure, or by way of shortening the chain element located between said rectangular-shaped metal frame structure and the connecting agent used to attach to said overhead tree limb. Adjustment of said telescoping side portions of said rectangular-shaped metal frame structure is severely limited to the vertical length of said telescoping side portions; said chain element is neither described nor claimed to be adjustable, however a user may conceivably choose to adjust the length of said chain by removing a portion of it, thereby raising the vertical distance of the apparatus relative to the ground. It is concluded that the means for adjusting height of this apparatus are notably limited.

Furthermore, as seen in Hense, Tandem Swing, U.S. Pat. No. 7,300,355 (Nov. 27, 2007), a swing invention is described as being attached to an overhead object at a singular attachment point by way of a chain element further containing a spreader bar element for the purpose of separating said chain element into right and left portions. Right and left seat elements are further attached to the ends of said right and left chain portions for the purpose of allowing two individuals to swing at the same time. Whereas this invention succeeds in employing means for separating a line by way of said line spreader element, it fails to provide means for the user to stand; fails to provide means for bouncing along a vertical plane; fails to provide means for lateral rotation; fails to provide means for height adjustment; restrictively requires simultaneous usage by two users; and, finally, fails to be quickly and easily attached to and detached from an overhead object.

The inventions described below comprise a freely spinning, bouncing swing apparatus, designed for use while the user is in a standing position. Said swing apparatus is quickly and easily attached to and detached from an overhead object by way of a singular bracing means, expediently adjusts length to accommodate the distance between an overhead object relative to the ground below while further accommodating a wide range of user heights by way of a convenient line tightening height adjuster element, provides an arc-shaped hollow line separator element through which a line feeds, provides foot placement bracing means atop a platform, is not bulky when being stored due to the yielding nature of a primary line element and the manner in which various connecting agents are composed, is lightweight due to the variety of high-strength lightweight materials from which the apparatus may be assembled, and is easy to manufacture due to the availability and simplicity of its parts.

SUMMARY OF THE INVENTION

The inventions described herein generally comprise a recreational swing apparatus that allows a user to stand up and bounce, spin and swing, comprising a series of connecting agents, a spring, and a line separator element that further support a line attached to supporting bands affixed to a rigid platform.

The swing of the invention is comprised of a singular bracing means anchored to a stationary overhead connection point, such as a tree limb, rail, or the like. An unrestrictedly-rotating coupling link element preferably comprising a side gate portion thereon, such as a swivel-eye carabiner or swivel-eye snap hook, joins said bracing means to an extension spring element. Said extension spring element further connects to a centrally located connecting agent affixed atop a hollow cylinder line separator element. Said line separator element is arc-shaped and contains right and left end point openings. A line element, such as a rope or wire, comprising right and left arm portions, equidistantly passes through said line separator element, extending some distance beyond said right and left end point openings of said line separator element. Lateral movement of said line within said line separator element is restricted by way of common stopping agents, such as washers and/or knots, placed along said right and left arm portions at the end points of said right and left end point openings. Said right and left arm portions further connect respectively to right and left supporting band elements, which further attach to a rigid platform element.

The inventions described provide right and left line tightener elements respectively located on said right and left arm portions for selectively adjusting the vertical length of said right and left arm portions, beneficially raising or lowering the height of said platform element relative to the ground, enabling the apparatus to unobstructively swing above the ground.

Furthermore, the inventions described beneficially provide ample vertical distance between said line separator element and said platform element such that a user may unobstructively stand upon said platform element.

Furthermore, by way of said line separator, the inventions described beneficially provide ample horizontal distance between said right and left arm portions, such that a user may unobstructively stand between said arm portions.

Furthermore, the inventions described beneficially provide a gap underneath said right and left supporting band elements for a user to removeably secure their feet while standing upon said platform element.

Furthermore, by way of said extension spring element, the inventions described beneficially provide the user an ability to bounce along a vertical plane.

Furthermore, an alternative embodiment of the inventions described herein beneficially provide for said right and left supporting band elements to removeably attach to an interchangeable platform element by way of a strap element. Said alternative embodiment beneficially provides for said right and left supporting band elements to removeably attach to a common skateboard.

Accordingly, in a first aspect of the invention, a swing apparatus is disclosed comprising a singular bracing means anchored to an overhead object, a coupling link element adjoining the bracing means to an extension spring, and further comprising a spinning swivel mechanism thereon. A hollow line separator element is provided comprising a connecting agent thereon for the extension spring to attach thereto. A line element is provided comprising right and left arm portions equidistantly extending through the line separator, and further comprising stopping agents thereon, and further attaching respectively to right and left supporting bands. The right and left supporting bands are provided fastened atop a rigid platform element, creating space for a user's feet to be insertably placed therebetween.

In a second aspect of the invention, the right and left supporting bands are provided comprising adjustable straps for wrapping around and adjoining to the platform element.

The inventions and their various embodiments can now be better understood by turning to the following description of the preferred embodiments which are presented as illustrated examples of the invention in any subsequent claims in any application claiming priority to this application. It is expressly understood that the invention as defined by such claims may be broader than the illustrated embodiments described below.

DETAILED DESCRIPTION OF THE INVENTION

Figure 1:
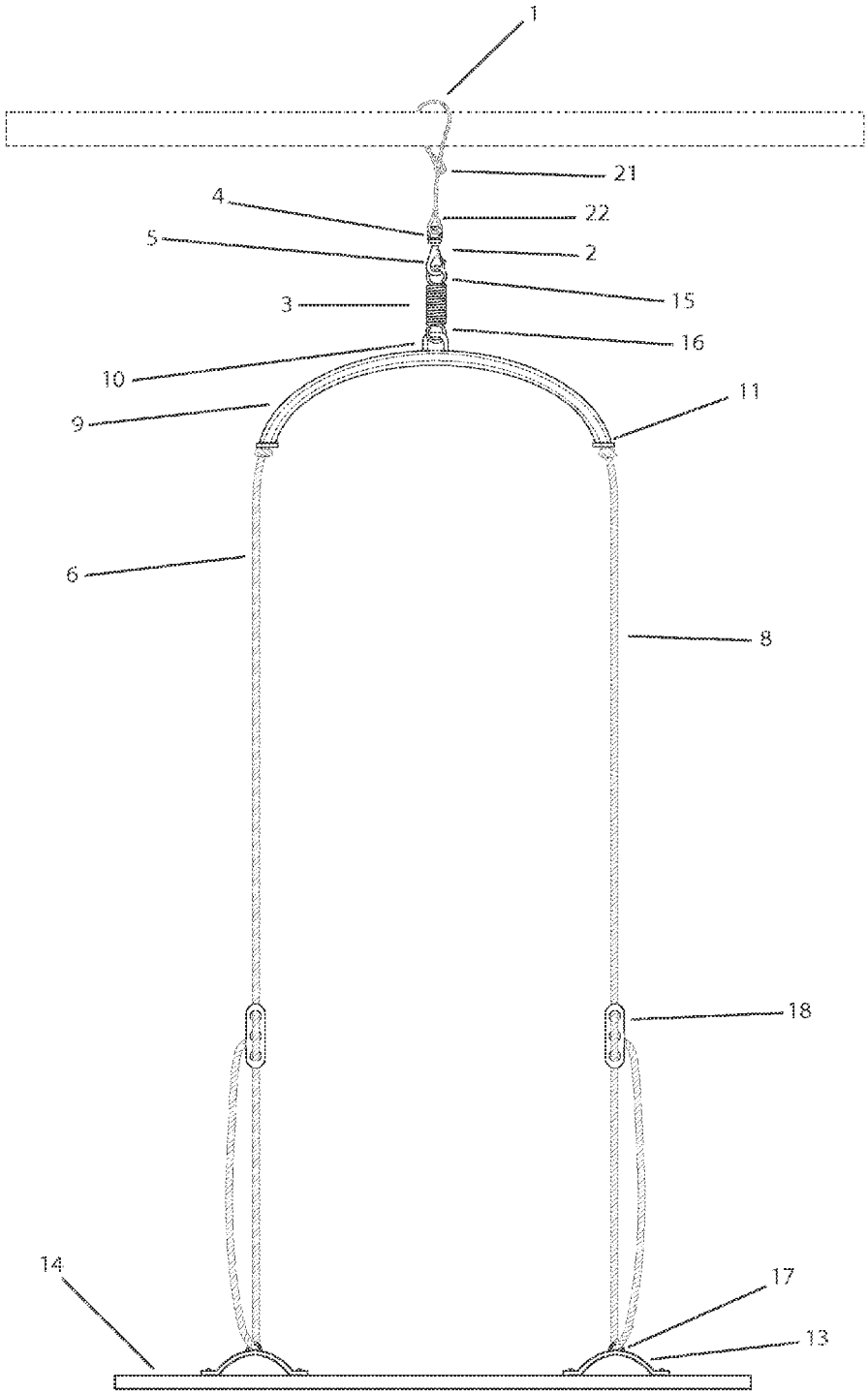
FIG. 1 is a front view of the swing apparatus of this invention.
Figure 2:
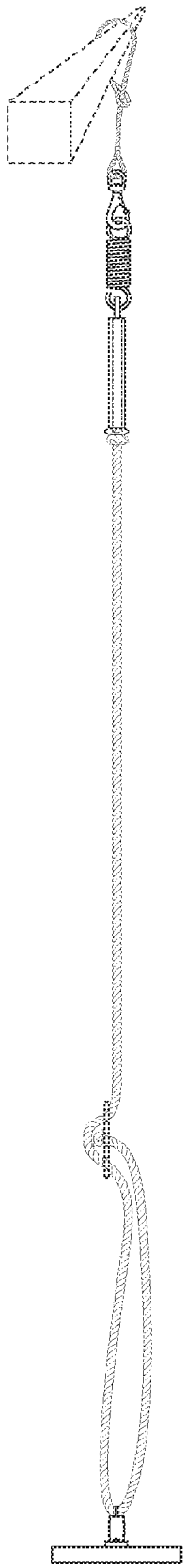
FIG. 2 is a side view of the apparatus of FIG. 1.

Turning now to the figures wherein like references define like elements among the several views, FIG. 1 shows a front view of the swing apparatus. The apparatus may comprise a Bracing Element 1 for anchoring to a stationary overhead tree limb, rail, or other similar such overhead object. In a preferred embodiment, Bracing Element 1 is comprised of a plastic-coated wire cable further comprising closed-end loops at opposing ends. However, any suitable bracing means can be used, such as a clamp, chain, ring, etc., provided said bracing means includes an attachment means for a Coupling Link Element 2. In said preferred embodiment, Bracing Element 1 is anchored to a stationary overhead object by way of wrapping one end of said cable around said overhead object. The user may further feed Loop Portion 22 through opposing Loop Portion 21, thereby cinching and securing said cable to said overhead object. In a preferred embodiment, Loop Portion 22 is smaller than Loop Portion 21, such that said Loop Portion 22 may unobstructedly pass through the larger aperture of Loop Portion 21. Loop Portion 22, thereby, further serves as an attachment means for Coupling Link Element 2.

Again referring to FIG. 1, Bracing Element 1 is attached to a Coupling Link Element 2. A preferred embodiment provides said Coupling Link Element 2 consisting of an Upper Connecting Portion 4, for Bracing Element 1 to attach thereto, and a Lower Connector Portion 5, for Extension Spring Element 3 to attach thereto, with a swivel mechanism therebetween. Said preferred embodiment provides for said Lower Connector Portion 5 to spin with unrestricted rotation as a result of said swivel mechanism. Said Lower Connector Portion 5 may further contain a gate mechanism on its side portion for releasably opening said Coupling Link 2. A beneficial result of such gate mechanism provides that Coupling Link 2 and Bracing Element 1 may remain attached to said overhead object, while all other elements may be quickly and conveniently detached. Such a coupling device is commonly known in the field of the art as a swivel-eye carabiner or swivel-eye snap hook, of which are commercially available and are manufactured in numerous shapes, sizes and strengths. Furthermore, in a preferred embodiment, a manufacturer provides that Upper Connecting Portion 4 of Coupling Link 2 permanently attaches to Loop Portion 22, thereby requiring Coupling Link 2 and Loop Portion 22 to both feed through the aperture of Loop Portion 21 when a user attaches Bracing Element 1 to said overhead object.

Again referring to the preferred embodiment, as shown in FIG. 1, said Coupling Link 2 is attached to an Extension Spring Element 3 by means of an Upper Connector Portion 15 contained thereon. The Extension Spring Element 3 component beneficially provides the user an ability to bounce along a vertical plane, thereby increasing a user's amusement when operating the swing apparatus. Extension Spring Element 3 is preferably made from a sturdy metal material, capable of supporting substantial weight. Such spring elements are commercially available and are manufactured in numerous shapes, sizes, and strengths, with numerous varieties of connector means. Upper Connector Portion 15 may be fashioned in the shape of a hook or an aperture, or any suitable shape, provided that the connector portion adjoins to said Coupling Link 2 in a suitably secure manner. Extension Spring Element 3 further comprises a Lower Connector Portion 16 for the purpose of adjoining to a Connecting Agent 10.

Figure 4:
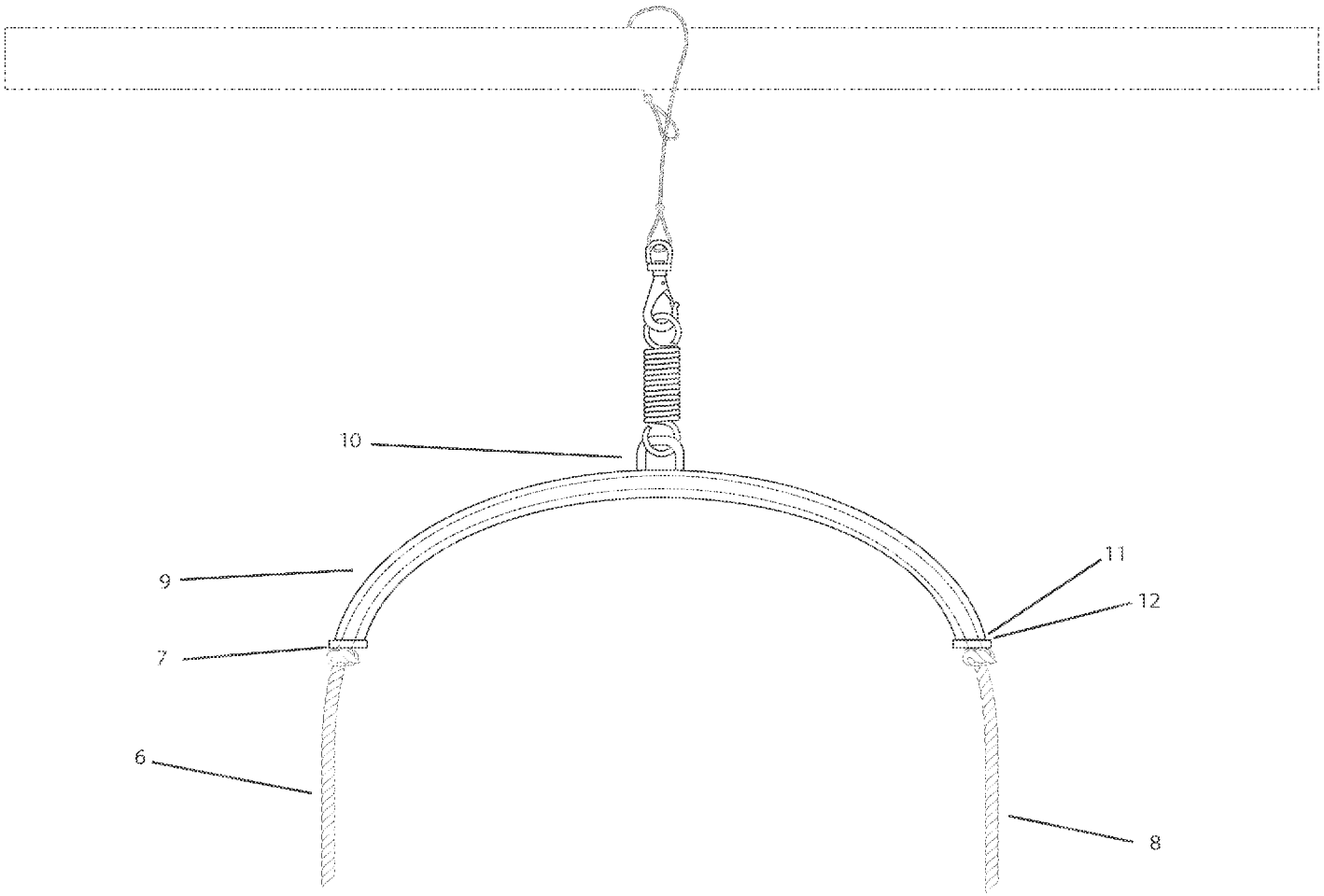
FIG. 4 is an exploded view of the connecting and separating agents contained on the apparatus of FIG. 1.

Turning briefly to an exploded view of a preferred embodiment, as shown in FIG. 4, an arc-shaped Line Separator Element 9 containing Right and Left End Point Openings 11 located at the respective lower-most opposing end points of the arc of said Line Separator Element 9 is provided. At the center upper-most point of said Line Separator Element 9, said Connecting Agent 10 is attached thereon by way of fasteners or welding, etc. Furthermore, said Line Separator Element 9 is a hollow cylinder, preferably constructed from a high-strength material, capable of withstanding the weight and force of the swing apparatus in use, such as metal or fiberglass-filled plastic.

Referring briefly to FIG. 1, Line Element 6 is provided, containing Right and Left Arm Portions 8. In a preferred embodiment, Line Element 6 is made from a suitable line capable of sustaining the weight of a user and the inertia force created while in use, such as a rope, cable, webbing, chain, etc.

Again referring to FIG. 4, Right and Left Stopping Agents 7 are administered to Right and Left Arm Portions 8 at Right and Left Meeting Points 12 respectively such that Line Element 6 is restricted from lateral movement within Line Separator Element 9. A preferred embodiment provides for a common washer to be held in place by a knot, however any such stopping agent suitable to the effect of restricting lateral movement of Line Element 6 is sufficient.

Referring back to FIG. 1, Right and Left Arm Portions 8 of Line Element 6 extend some distance beyond Right and Left End Point Openings 11 of Line Separator Element 9 and respectively attach to right and left bracing means, such as Right and Left Support Bands 13. Said Right and Left Support Bands 13 contain centrally located anchoring means for attaching to said Right and Left Arm Portions 8. A preferred embodiment of such anchoring means is Right and Left Connecting Agents 17, provided such that Right and Left Arm Portions 8 pass through an aperture located on said Right and Left Connecting Agents 17. Said Right and Left Arm Portions 8 further fasten to a suitable line tightening device, such as Right and Left Line Tightener Elements 18. Such line tightening devices are common in the field of the art and commonly consist of a series of three apertures located along a portion of rigid material, allowing a line to feed through said apertures in such a way that said line is fastened to said rigid material, and further provides means for adjusting the length of said line relative to an anchor point.

Again referring to FIG. 1, said Right and Left Support Bands 13 attach to a Platform Element 14. A preferred embodiment provides that Right and Left Support Bands 13 are arc-shaped elements with anchor points located at opposing ends of the arc for the purpose of being fastened to said Platform 14. Any suitable fastener known in the art is provided, such as a screw, bolt, etc. The preferred arc shape of said Right and Left Support Bands 13 provides a space between the arc and said Platform Element 14 for the purpose of a user's feet to be insertably placed therebetween. Said Platform Element 14 is comprised of any such rigid material known in the art that provides ample strength to support the weight of a user, such as wood, metal, plastic, etc.

Figure 3:
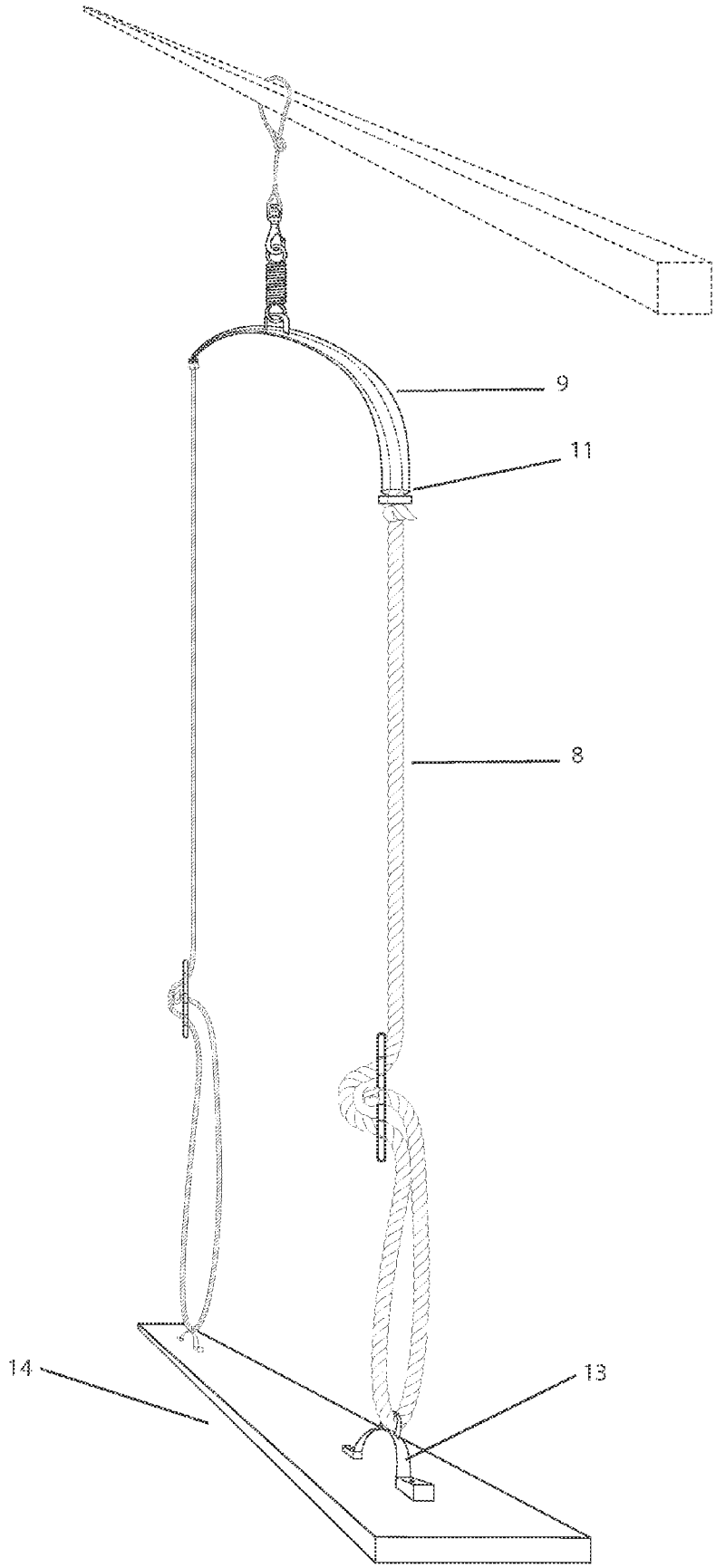
FIG. 3 is a perspective view of the apparatus of FIG. 1.

Referring briefly to a perspective view of a preferred embodiment, as shown in FIG. 3, wherein Right and Left Arm Portions 8 extend some distance from Right and Left End Point Openings 11 of Line Separator Element 9 to Right and Left Support Bands 13 such that a user may unobstructively stand on said Platform Element 14. Furthermore, the horizontal length of Line Separator Element 9 beneficially provides ample distance between said Right and Left Arm Portions 8 such that a user may unobstructively stand upon said Platform Element 14 between said Right and Left Arm Portions 8.

Figure 5B:
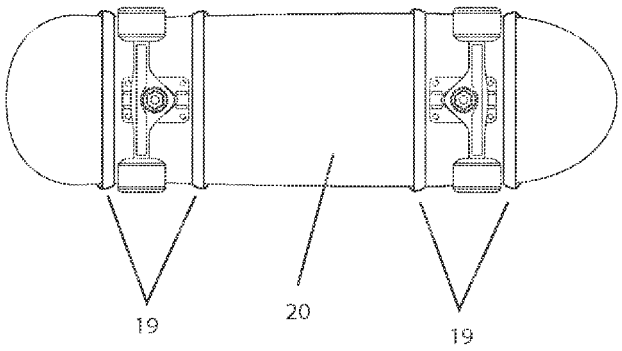
FIGS. 5*a-b* include an exploded perspective view and a bottom view of an alternative embodiment of the apparatus.
Figure 5A:
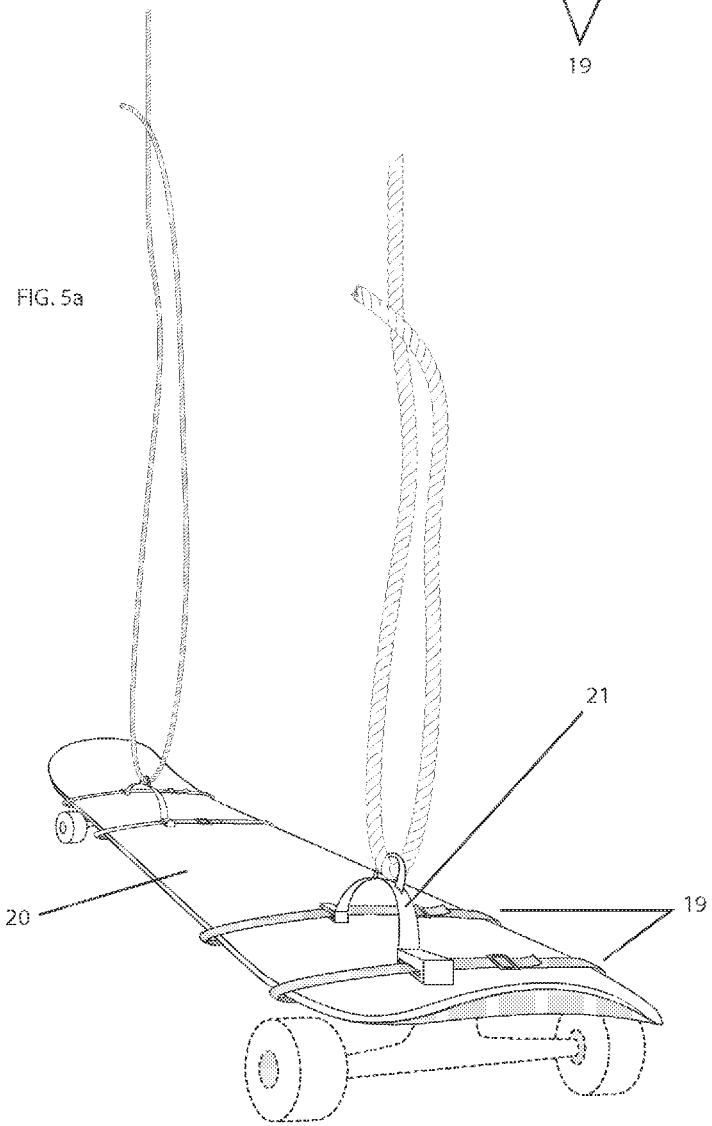

As an alternative embodiment, as shown in FIGS. 5*a-b*, Right and Left Support Bands 21 are removeably attached to a Skateboard 20 by way of Cinching Straps 19. In this alternative embodiment, Cinching Straps 19 are made from a high-strength webbing, rope, or cable. Furthermore, this alternative embodiment provides that Right and Left Support Bands 21 are arc-shaped elements with attachment means located at opposing ends of the arc for the purpose of Cinching Straps 19 to pass through and wrap around said Skateboard 20. Tightening, or cinching, of said Cinching Straps 19 results in said Right and Left Support Bands 21 being fastened to said Skateboard 20. A benefit of this alternative embodiment provides for any number of suitable platforms to be removeably attached to the swing apparatus.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by any claims in any subsequent application claiming priority to this application.

For example, notwithstanding the fact that the elements of such a claim may be set forth in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus, if an element can be understood in the context of this specification as including more than one meaning, then its use in a subsequent claim must be understood as being generic to all possible meanings supported by the specification and by the word itself.

The definitions of the words or elements of any claims in any subsequent application claiming priority to this application should be, therefore, defined to include not only the combination of elements which are literally set forth, but all equivalent structure, material or acts for performing substantially the same function in substantially the same way to obtain substantially the same result. In this sense, it is therefore contemplated that an equivalent substitution of two or more elements may be made for any one of the elements in such claims below or that a single element may be substituted for two or more elements in such a claim.

Although elements may be described above as acting in certain combinations and even subsequently claimed as such, it is to be expressly understood that one or more elements from a claimed combination can in some cases be excised from the combination and that such claimed combination may be directed to a subcombination or variation of a subcombination.

Insubstantial changes from any subsequently claimed subject matter as viewed by a person with ordinary skill in the art, now known or later devised, are expressly contemplated as being equivalently within the scope of such claims. Therefore, obvious substitutions now or later known to one with ordinary skill in the art are defined to be within the scope of the defined elements.

Any claims in any subsequent application claiming priority to this application are thus to be understood to include what is specifically illustrated and described above, what is conceptually equivalent, what can be obviously substituted and also what essentially incorporates the essential idea of the invention.

I claim:

1. A swing apparatus comprising:

A singular bracing means anchored to an overhead object;

a coupling link element adjoining the bracing means to an extension spring, and further comprising a spinning swivel mechanism thereon;

an extension spring element;

a hollow line separator element comprising a connecting agent thereon for the extension spring to attach thereto;

a line element comprising right and left arm portions equidistantly extending through the line separator, and further comprising stopping agents thereon, and further attaching respectively to right and left supporting bands;

right and left supporting bands fastened atop a platform element, and further providing space for a user's feet to be insertably placed therebetween;

a rigid platform element.

2. A swing apparatus comprising:

A singular bracing means anchored to an overhead object;

a coupling link element adjoining the bracing means to an extension spring, and further comprising a spinning swivel mechanism thereon;

an extension spring element;

a hollow line separator element comprising a connecting agent thereon for the extension spring to attach thereto;

a line element comprising right and left arm portions equidistantly extending through the line separator, and further comprising stopping agents thereon, and further attaching respectively to right and left supporting bands;

right and left supporting bands comprising adjustable straps for wrapping around and adjoining to a platform element, and further providing space for a user's feet to be insertably placed therebetween;

a rigid platform element.

* * * * *